United States Patent [19]

Suzuki et al.

[11] Patent Number: 4,566,562

[45] Date of Patent: Jan. 28, 1986

[54] TRACTION ELEVATOR APPARATUS

[75] Inventors: Katsuhiko Suzuki, Nagoya; Takenobu Honda, Inazawa, both of Japan

[73] Assignee: Mitsubishi Denki Kabushiki Kaisha, Japan

[21] Appl. No.: 460,798

[22] Filed: Jan. 25, 1983

[30] Foreign Application Priority Data

Feb. 5, 1982 [JP] Japan ..... 57-14905[U]

[51] Int. Cl.[4] ..... B66B 11/04

[52] U.S. Cl. ..... 187/22; 254/264; 74/89.22

[58] Field of Search ..... 187/1 R, 20, 27, 22, 187/23, 94; 254/264, 371; 226/168; 74/505, 506, 10.7, 89.22, 89.2

[56] References Cited

U.S. PATENT DOCUMENTS

| | | | |
|---|---|---|---|
| 1,132,769 | 3/1915 | Gale, Sr. | 187/22 |
| 2,270,441 | 1/1942 | Hymans | 187/22 |
| 3,087,343 | 4/1963 | Wabbe | 74/89.22 |
| 3,838,752 | 10/1974 | Berkovitz | 187/20 |
| 4,172,509 | 10/1979 | Miyagi et al. | 187/1 R |
| 4,351,197 | 9/1982 | Carson | 74/506 |
| 4,401,406 | 8/1983 | Rovira | 74/89.2 |
| 4,404,863 | 9/1983 | James | 74/89.22 |

FOREIGN PATENT DOCUMENTS

| | | | |
|---|---|---|---|
| 197042 | 4/1908 | Fed. Rep. of Germany | 187/20 |
| 2441992 | 4/1975 | Fed. Rep. of Germany . | |
| 2312449 | 3/1976 | France | 187/20 |
| 417432 | 10/1947 | Italy | 74/89.2 |
| 1313214 | 7/1969 | United Kingdom . | |
| 1206810 | 9/1970 | United Kingdom . | |
| 2002711 | 2/1979 | United Kingdom . | |
| 1599586 | 10/1981 | United Kingdom . | |

*Primary Examiner*—Joseph J. Rolla
*Assistant Examiner*—Kenneth Noland
*Attorney, Agent, or Firm*—Leydig, Voit & Mayer Ltd.

[57] ABSTRACT

A traction elevator apparatus characterized in that a deflector wheel is disposed in a manner to lie below a driving sheave, and that a rope wound on the driving sheave is extended over the deflector wheel in a manner to cause the cage side and balance weight side parts of the rope to cross each other on the lower side of the driving sheave.

5 Claims, 7 Drawing Figures

TRACTION ELEVATOR APPARATUS

BACKGROUND OF THE INVENTION

This invention relates to a traction elevator apparatus, and more particularly to enhancement in the traction ability thereof.

In recent years, conservation of resources and the reduction of cost have been applied also to the elevator industry. It has accordingly been proposed to lighten the weight of elevator cages and to make the diameter of elevator sheaves smaller. With this measure, however, slip between the driving sheave and the rope connecting the cage and a balance weight is likely to occur. It is accordingly desired to enhance the traction ability thereof.

FIG. 1 illustrates the roping system of a single lap type traction elevator of a prior art. Numeral 1 designates the driving sheave of an elevator hoist, and numeral 2 the deflecting wheel thereof. A rope or cable 3 is extended over the sheave 1 and the deflector wheel 2. A cage 4 and a balance weight 5 are respectively connected to the ends of the rope 3.

In such a system, the angle $\theta$ over which the rope 3 is wound on the driving sheave 1 becomes less than 180°. The rope winding angle $\theta$ for the case where the deflector wheel 2 is not utilized, becomes 180°.

That is, with the prior art roping system as shown in FIG. 1, the rope winding angle $\theta$ is not more than 180° which makes it very difficult to yield high traction characteristics, and in turn, to lighten the weight of the cage itself for the purposes of saving materials and reducing the cost thereof.

SUMMARY OF THE INVENTION

This invention has been made in order to solve the disadvantages of the prior art, and has for its object to provide a traction elevator apparaus having a structure in which the winding angle of a rope with respect to a driving sheave can be made greater than 180°, consequently enhancing the traction ability thereof, thereby facilitating the use of lighter weight cages as well as allowing the use of smaller diameter sheaves.

In order to accomplish the above mentioned objects, according to the present invention, a deflecting wheel is arranged in a manner to lie below a driving sheave, and a rope wound on the driving sheave is wound on the deflecting wheel (also referred to herein as deflector wheel) in such a manner that the cage side and balance weight side of the rope cross each other on the lower side of the driving sheave. This brings forth the effect that the winding angle $\theta$ of the rope with respect into the driving sheave can be made greater than 180° thereby enhancing the traction ability thereof. In turn the weight of the cage itself can be reduced and the diameter of the sheave can be decreased resulting in the reduction of construction material as well as the reduction in cost.

DESCRIPTION OF THE PREFERRED EMBODIMENTS

Figure 1:
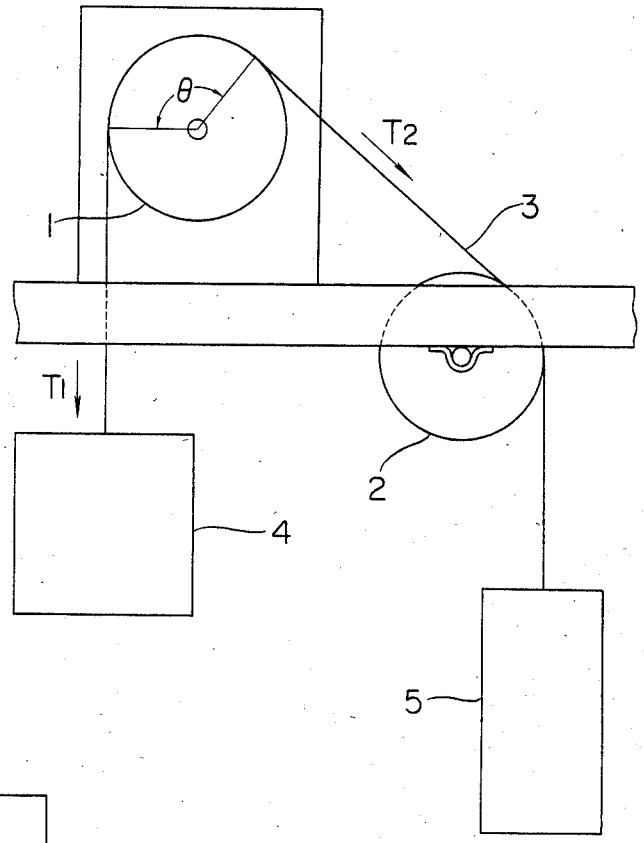
FIG. 1 PRIOR ART
FIG. 1 is a schematic arrangement diagram of a prior art traction elevator apparatus.
Figure 2:
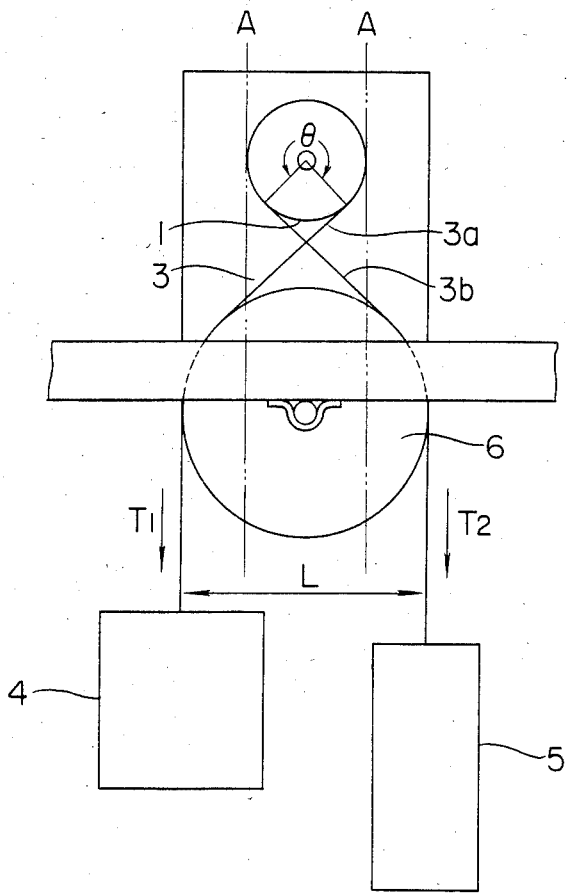
FIG. 2 is a schematic arrangement diagram showing an embodiment of a traction elevator apparatus according to the present invention.

FIG. 2 shows an embodiment of a single lap type traction elevator apparatus according to the present invention.

Positioned underneath the driving sheave 1 of an elevator hoist (not shown), is disposed a deflecting wheel 6 which has a diameter larger than that of the driving sheave 1, for illustrative purposes. A rope or cable 3 is wound around the driving sheave 1 having a cage side rope part **3*a* and balance weight side rope part 3*b* wound on the deflecting wheel 6 in a manner so that said parts cross each other in the space between the driving sheave 1 and the deflecting wheel 6. The rope part 3*a* on the side of the driving sheave 1 closer to a balance weight 5 is wound around the cage side of the deflector wheel 6, while the rope part 3*b* on the side of the driving sheave 1 closer to the cage 4 is wound on the balance weight side of the wheel 6. The cage 4 and the balance weight 5 are attached to the suspending ends of the respective rope parts 3*a* and 3*b*. Thus, the winding angle $\theta$ of the rope 3 with respect to the driving sheave 1** can be made greater than 180°.

The "traction ability" as a function of the rope tension ratio $T_1/T_2$ between the rope and the driving sheave can be defined by the following expression:

$$T_1/T_2 = e^{\mu\theta} \quad (1)$$

where $T_1$: rope tension on the cage side, $T_2$: rope tension on the balance weight side, e: base of the natural logarithm, $\mu$: apparent friction factor between the groove of the driving sheave and the rope, and $\theta$: winding angle of the rope of the driving sheave.

The winding angle $\theta$ of the rope 3, which can be made greater than 180° as described above, signifies that the traction ability can be increased as is apparent from Expression (1) mentioned above. Consequently, a lighter weight cage 4 and a smaller diameter sheave 1 can be utilized.

With the embodiment of this invention shown in FIG. 2, when the elevator becomes large in size, the deflector wheel 6 also becomes large resulting in very large deflector wheel which is not desirable from an economic view point. Another embodiment overcoming the above mentioned drawback is shown in FIG. 3 according to the present invention.

Figure 3:
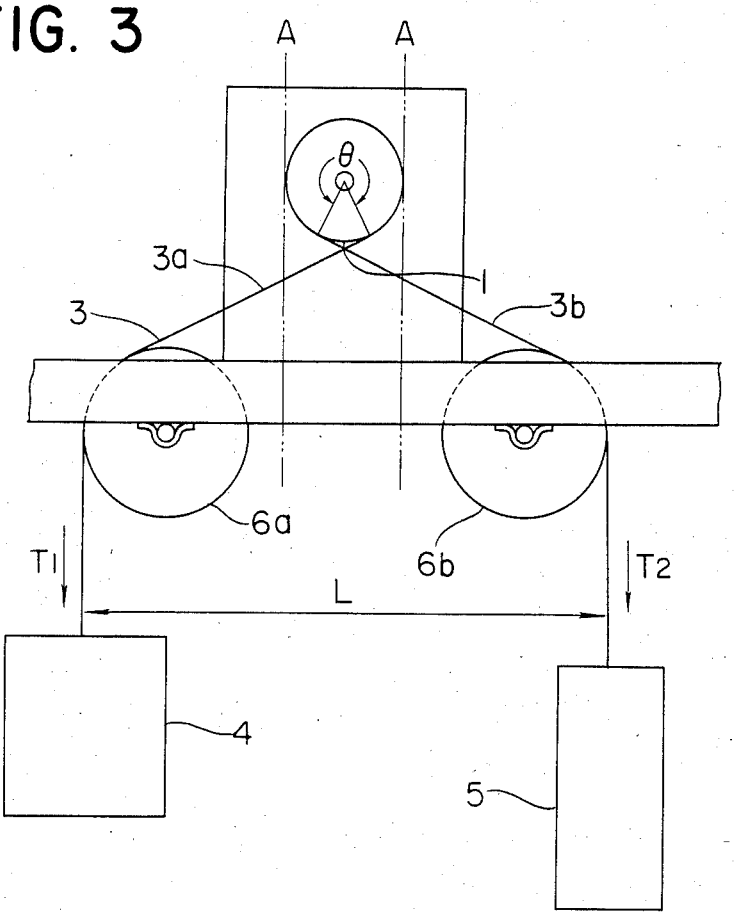
FIG. 3 is a schematic arrangement diagram showing another embodiment of the traction elevator apparatus according to the present invention.

In the embodiment of FIG. 3, a deflector wheel **6*a* for a cage 4 and a deflector wheel 6*b* for a balance weight 5 are disposed below and on opposite sides of a driving sheave 1. The rope 3 is wound around the driving sheave 1. The cage side rope part 3*a* of the rope 3 on the side of the driving sheave 1 closer to the balance weight 5 extends over the cage side deflector wheel 6*a*, while the balance weight side rope part 3*b*, on the side of the driving sheave 1 closer to the cage 4 extends over the balance weight side deflector wheel 6*b***. Thus, the rope parts 3*a* and 3*b* cross each other on the lower side of the driving sheave 1 thereby yielding a winding angle $\theta$ of the rope 3 on the driving sheave 1 which is greater than 180°.

In this manner, the traction ability can be increased allowing for the usage of smaller diameter deflector wheels.

Although the embodiment shown in FIG. 3 reduces the diameter of the deflector wheel, it also requires the usage of two deflector wheels, which is undesirable from the aspect of cost. Still another embodiment shown in FIG. 4 overcomes the above mentioned drawback according to the present invention.

Figure 4:
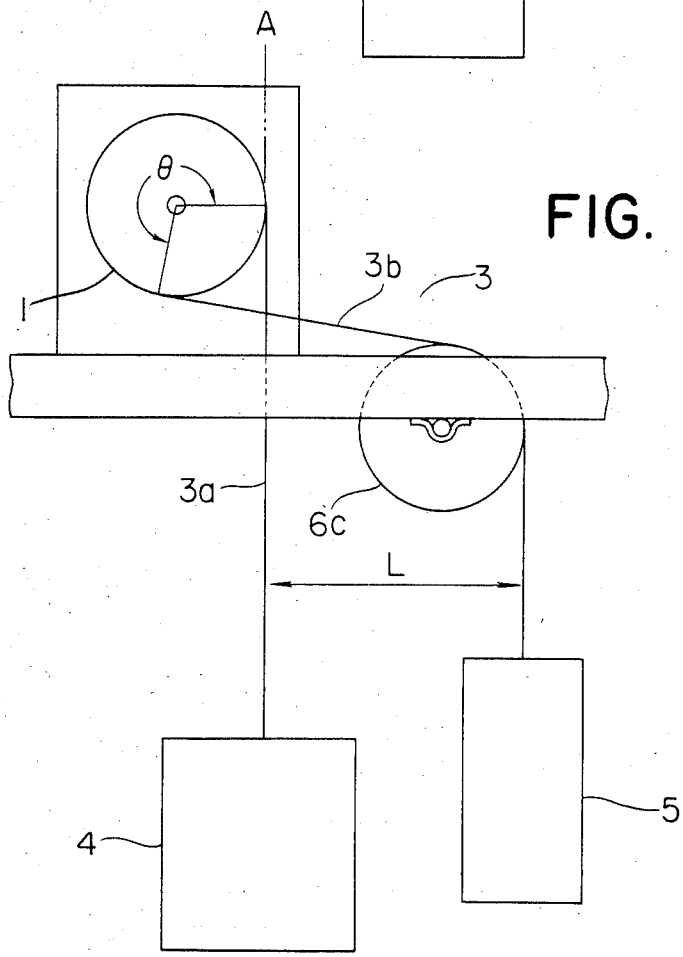
FIG. 4 is a schematic arrangement diagram showing still another embodiment of the present invention.

Referring to FIG. 4, a deflector wheel 6*c* is positioned below and to one side of the driving sheave 1. A rope 3 is wound around the sheave 1 having a rope part 3*b* on the side of the sheave 1 furthest from the deflector wheel 6*c* extend over the deflector wheel 6*c* and having a rope part 3*a* on the side of the sheave 1 closer to the deflector wheel 6*c*. The ends of said rope parts 3*a*, 3*b* are connected to the cage 4 and balance weight 5, respectively. By winding and extending the rope 3 in this manner, the rope parts 3*a*, 3*b* cross each other under the sheave 1. Accordingly, the winding angle $\theta$ of the rope 3 on the sheave 1 becomes greater than 180°.

In this manner, the traction ability can be enhanced by means of a single deflector wheel which is small in size.

As thus far described, according to the present invention, at least one deflector wheel is arranged below a sheave in such a manner that part or all the circumferential surface of the deflector wheel lies outside the vertical tangent with respect to the sheave surface. Further, a rope is wound on said sheave and said deflector wheel in a manner so that parts of said rope cross under said sheave. Therefore, the angle $\theta$ over which the rope is wound on the sheave can be made greater than 180°, and accordingly the traction ability can be increased.

This is especially so when utilized with single lap type traction elevators.

While the foregoing embodiments have exemplified the construction in which the driving sheave is disposed above the cage, this invention is also applicable to a construction in which a sheave is installed below the cage, that is, in the lowest part of a shaft.

In addition, the distance L between the parallel parts of the cage side rope part 3*a* and the balance weight side rope part 3*b* is set so as to prevent the cage and the balance weight from interfering with each other, by properly selecting the diameter and installation position of the deflector wheel.

In the systems illustrated in the foregoing embodiments, it is feared that the rope parts 3*a* and 3*b* may interfere at the crossing parts thereof. To eliminate the above mentioned fear, a groove with which the cage side rope part 3*a* is held in engagement and a groove with which the balance weight side rope part 3*b* is held in engagement may be individually formed in the deflector wheel or wheels so as to establish a safe distance between the crossing parts of both the rope parts owing to the grooves.

Figure 5:
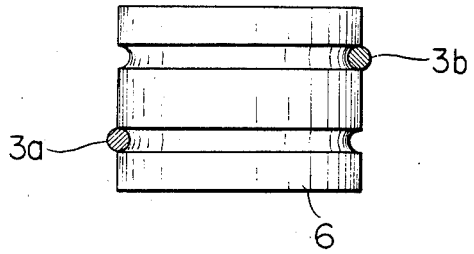
FIGS. 5 to 7 are plan views showing the positions of grooves formed in deflector wheels, and corresponding to the embodiments of FIGS. 2 to 4, respectively.
Figure 6:
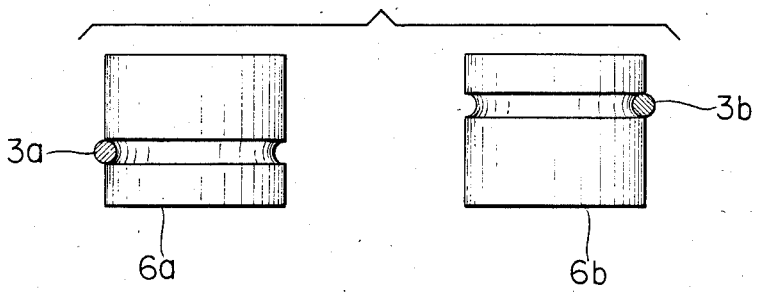
Figure 7:
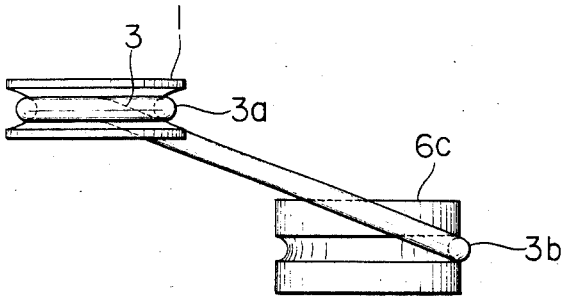

Such embodiments corresponding to the foregoing embodiments of FIGS. 2–4 are respectively shown in FIGS. 5–7.

What is claimed is:

1. A traction elevator apparatus comprising a driving sheave on which a rope is wound, said rope connected to a cage at a first end and to a balance weight at a second end, a deflector wheel having a diameter larger than said driving sheave, said first and second ends of said rope crossing each other on the lower side of said driving sheave intermediate said driving sheave and said deflector wheel and extending over and contacting opposite sides of the circumferential surface of said deflector wheel, a part of the circumferential surface of said deflector wheel being located outside a vertical tangent to said driving sheave a sufficient distance to prevent said cage and said balance weight from interfering with each other.

2. A traction elevator apparatus according to claim 1 wherein the angle over which said rope is wound on said driving sheave is greater than 180 degrees.

3. A traction elevator apparatus according to claim 1 wherein the circumferential surface of said deflector wheel has formed therein first and second annular grooves which engagingly contact said first and second ends of said rope, said first and second annular grooves being arranged in different planes, thereby preventing interference of said first and second ends of said rope and of said cage and said balance weight.

4. A traction elevator apparatus according to claim 1 wherein said deflector wheel is located substantially vertically below said driving sheave.

5. A traction elevator apparatus according to claim 4 wherein each of said driving sheave and said deflector wheel have rotational axes and the axis of said driving sheave is superposed above the axis of said deflector wheel.

* * * * *